US005529010A

United States Patent [19]

Johnson et al.

[11] Patent Number: 5,529,010

[45] Date of Patent: Jun. 25, 1996

[54] TRANSOM LINK METHOD AND APPARATUS

[75] Inventors: Larry G. Johnson, Mill Creek; Joel Altus, Seattle, both of Wash.

[73] Assignee: Foss Maritime Company, Seattle, Wash.

[21] Appl. No.: 425,898

[22] Filed: Apr. 21, 1995

[51] Int. Cl.[6] ..... B63B 9/00

[52] U.S. Cl. ..... 114/221 R; 114/251

[58] Field of Search ..... 114/199, 200, 114/210, 211, 212, 213, 221 R, 293, 294, 242, 251, 253, 254, 230

[56] References Cited

U.S. PATENT DOCUMENTS

| | | | |
|---|---|---|---|
| 1,417,222 | 5/1922 | Abraham | 114/253 |
| 2,551,998 | 5/1951 | De Groot | 294/66 |
| 2,721,088 | 10/1955 | Ritter, Jr. | 280/480 |
| 2,861,535 | 11/1958 | Hutchison et al. | 114/218 |
| 2,920,598 | 1/1960 | Nielsen | 114/235 |
| 2,984,202 | 5/1961 | Lunde | 114/251 |
| 3,097,498 | 7/1963 | Laborde et al. | 61/46.5 |
| 3,319,426 | 5/1967 | Slonczewski | 61/72.3 |
| 3,927,636 | 12/1975 | Childers et al. | 114/206 R |
| 4,242,978 | 1/1981 | Fuller | 114/253 |
| 4,579,075 | 4/1986 | Foreman | 114/253 |
| 4,751,892 | 6/1988 | Sechel et al. | 114/221 R |
| 5,215,344 | 6/1993 | Augustyniak | 114/221 R |

*Primary Examiner*—Stephen Avila
*Attorney, Agent, or Firm*—Seed and Berry

[57] ABSTRACT

A transom link for a tugboat is used to rescue an escorted ship that has lost the ability to maneuver. A transom link is a high-strength, oblong member, having a pivot arm that pivots open to allow a closed eye of a line to be captured by the transom link. The tugboat maneuvers close to the escorted ship so that a member of the tugboat's crew can seize a pennant line attached to the ship. The transom link is attached to the tugboat's tow line and the ship's pennant line is brought to the transom link. The tugboat's crew member forces open the pivot arm of the transom link and captures the closed eye of the ship's pennant line in the transom link. The tow line of the tugboat is let out to distance the tugboat from the escorted ship and then the tugboat maneuvers as needed to complete the rescue of the escorted ship.

16 Claims, 3 Drawing Sheets

TRANSOM LINK METHOD AND APPARATUS

TECHNICAL FIELD

The present invention relates generally to tethering a tug to a distressed ship and, more particularly, to dynamically capturing a pennant line of the distressed ship while the ship and tug are in motion.

BACKGROUND OF THE INVENTION

Numerous instances exist where large ships must be rescued in the event of their disablement, such as by loss of power. These instances are invariably urgent. In particular, oil tankers or other ships transporting environmentally sensitive cargoes present especially high risks when in restricted or otherwise hazardous waterways. It is imperative that such distressed ships be brought under control in a timely manner. In certain waterways, depending on the conditions and transit speeds, there may be no more than two minutes before the ship comes to grief.

While such ships are required by law to be escorted by one or more tugboats during transits in confined waterways, the ships generally are not tethered to the tugboats because of the hazards associated with doing so. Such hazards are well known and would require the tugboat to match the speed of the ship at all times. Therefore, it is imperative that a suitable means be provided by which the tugboat can tether to a distressed ship on demand.

One method for rescuing distressed barges is discussed in U.S. Pat. No. 4,242,978 to Fuller. Fuller discloses a hook assembly for retrieving a chain bridle component of a broken towing line used by a tugboat to tow a barge. The tugboat passes back and forth near the barge until the hook of the hook assembly captures one of the links in the chain bridle. The Fuller hook assembly is inadequate for at least three reasons. First, such a chain bridle as described in the Fuller patent is used to recapture a barge whose towing line has parted. A ship that is escorted rather than towed does not have a chain bridge rigged to the ship. Second, such a chain bridle and hook assembly are not strong enough to capture a ship under its own power at speeds up to 12 knots. Third, if the hook of the hook assembly does not capture the chain bridle in the first couple of passes of the tugboat, the danger to the distressed ship is magnified greatly.

Another system recently proposed to rescue distressed ships employs a large articulated arm extending upwardly and rearwardly from the stern of a tugboat. A connection line is coupled at one end to a towing line of the tugboat and at its other end to the free end of the articulating arm. The articulating arm is remote-controlled to connect the connection line to a hookup point on the distressed ship. Such a remote controlled articulating arm is a very expensive addition to each tugboat. In addition, maneuvering the tugboat and the articulating arm simultaneously to connect the connection line to the distressed ship is very complicated and thus highly susceptible to failure.

Due to their inadequacies, the Fuller hook assembly and the remote controlled articulating arm have failed to alleviate the need for a quick and safe method of rescuing distressed ships. As such, the rescue of distressed ships continues to require several crew members of the tugboat and the distressed ship to throw ropes between the vessels and tie the ropes to connection points on the tugboat and the distressed ship. Such methods are very dangerous to the crew members and often require more time than is available to rescue the distressed ship.

SUMMARY OF THE INVENTION

It is an object of the present invention to safely rescue a distressed ship using a tugboat.

It is another object of the invention to rescue the distressed ship with minimal assistance from crew members on the distressed ship.

It is another object of the invention to rescue the distressed ship quickly before the distressed ship comes to grief.

These and other objects are satisfied in the invention by a transom link and a method of capturing the distressed ship using a tugboat equipped with such a transom link. A transom link is a high-strength, oblong member having a pivot arm that pivots open to allow a closed eye of a rope or line to be captured by the transom link. The tugboat maneuvers close to the escorted ship so that a member of the tugboat's crew can seize a pennant line attached to the ship. The transom link is attached to the tugboat's tow line and the ship's pennant line is brought to the transom link. The tugboat's crew member forces open the pivot arm of the transom link and captures a closed eye of the ship's pennant line in the transom link. The tow line of the tugboat is let out to distance the tugboat from the escorted ship and then the tugboat maneuvers as needed to complete the rescue of the escorted ship.

DETAILED DESCRIPTION OF THE INVENTION

The present invention is directed to a transom link and a method of capturing a ship using a tugboat equipped with such a transom link. The transom link is a high-strength, oblong member, similar to a chain link, having a pivot arm that pivots open to allow a closed eye of a rope or line to be captured by the transom link. The transom link is employed when a ship escorted by the tugboat loses power or otherwise becomes unable to maneuver itself. The tugboat maneuvers close to the escorted ship so that a member of the tugboat's crew can seize a pennant line attached to the escorted ship. The transom link is attached to the tugboat's tow line. The escorted ship's pennant line is brought to the transom link, and the tugboat's crew member forces open the pivot arm of the transom link and captures a closed eye of the ship's pennant line in the transom link. The tow line of the tugboat is let out to distance the tugboat from the escorted ship and then the tugboat maneuvers as needed to complete the rescue of the escorted ship. As such, the transom link enables the tugboat to rescue the escorted ship in a very short time period with minimal danger to the crews of the escorted ship and the tugboat.

Figure 1:
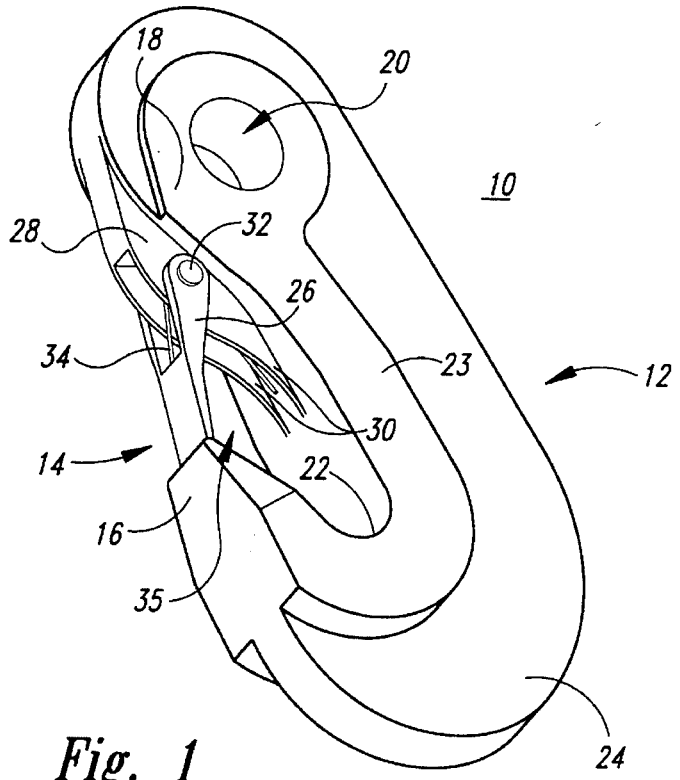
FIG. 1 is an isometric view of a transom link according to the present invention.

Shown in FIG. 1 is a preferred embodiment of a transom link 10 according to the present invention. The transom link 10 includes an oblong hook member 12 having an opening 14 formed between a hook tip 16 and a hook base 18. The hook base 18 includes a transverse bore 20 that receives a link pennant coupled to the tugboat's towing line as will be discussed in more detail with respect to FIG. 2. Adjacent the hook tip 16 is an end saddle 22 coupled to the hook base 18 by a fixed back arm 23. The end saddle 22 receives the distressed ship's pennant line to couple the tugboat to the distressed ship as will be discussed in more detail with respect to FIGS. 3–5. Integrally coupled to the hook member 12 is a support ridge 24 that provides sufficient strength to enable to transom link 10 to be used to couple the tugboat to the distressed ship and thereby rescue the distressed ship. In a preferred embodiment, the transom link is certified at over 1,000,000 pounds, which has been found to be sufficiently strong to allow a tugboat to slow down and change the course of very large ships, such as oil tankers.

Pivotally coupled to the hook member 12 is a pivot arm 26 that extends across the opening 14 in the hook member. The hook member 12 at the hook base 18 includes a bridge 28 with two spaced-apart side arms 30 extending toward the end saddle 22. The pivot arm 26 is pivotally coupled to the bridge 28 via a pivot pin 32 extending through the side arms 30. The pivot arm 26 is spring loaded by a spring 34 that biases a free end portion of the pivot arm into contact with an underside of the hook end 16 to thereby close the opening 14 of the hook member 12. When the pivot arm 26 closes the opening 14 of the hook member 12, an enclosed interior area 35 is formed in the transom link 10 by the pivot arm 26 and the hook member 12. The spring 34 is preferably a coil spring coaxially mounted preferably on the pivot pin 32 between the side arms 30. In a preferred embodiment, approximately 25 pounds of force is required to overcome the biasing force of the spring 34 and thereby pivot the pivot arm 26 inward into an open position that allows the ship pennant line to be inserted between the pivot arm and the hook tip 16.

Figure 2:
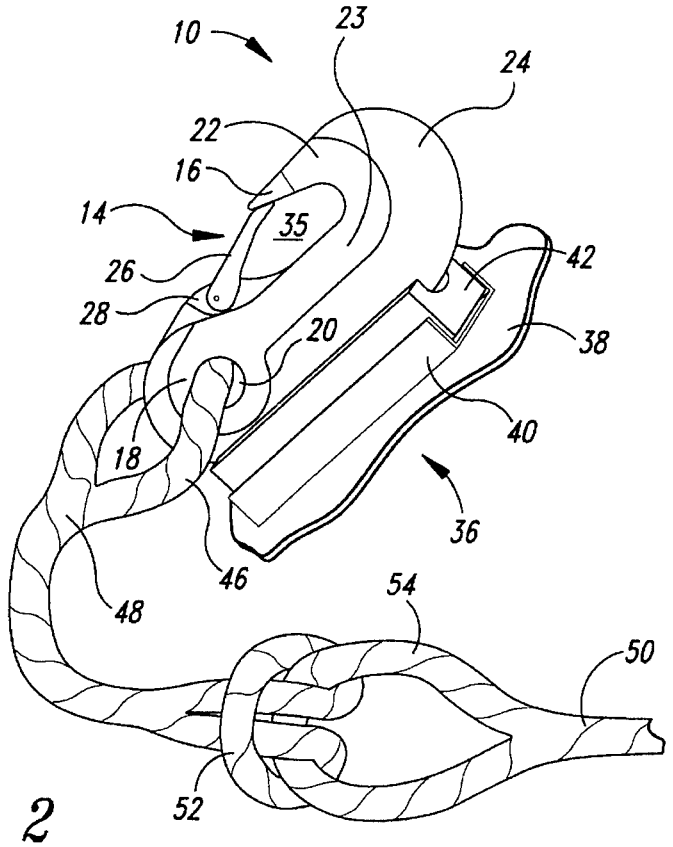
FIG. 2 is a reduced scale, isometric view of the transom link of FIG. 1 coupled to a transom link cradle attached to a tugboat according to the present invention.

Shown in FIG. 2 is a detailed view of the transom link 10 coupled to a transom link cradle 36 attached to the stern of an tugboat 38. The transom link cradle 36 includes a shell unit 40 securely attached to the tugboat stern. Securely seated within the shell unit 40 is a resilient jig 42 that resiliently receives and grasps the support ridge 24 of the transom link 10. The jig 42 is angled and sized to hold the transom link 10 in place within the cradle during transit. Captured within the transverse bore 20 of the transom link 10 is a first closed eye 46 of a link pennant 48 that is used to attach the transom link to a tow line 50 of the tugboat 38. The first closed eye 46 is captured by inserting the link pennant 48 through the transverse bore 20 of the transom link and then splicing the link pennant to itself to form the closed eye. In order to connect the link pennant 48 to the tow line 50, the link pennant 48 includes a second closed eye 52 that is tied to a closed eye 54 of the tow line 50. The closed eyes 52, 54 are tied together by inserting the second closed eye 52 through the towline closed eye 54 and then inserting the transom link 10 and link pennant 48 through the second closed eye 52 until the second closed eye 52 closely wraps about the towline eye 54. Preferably, the transom link 10 is coupled to the tow line 50 via the link pennant 48 at all times so that the transom link is always ready to be used to rescue a distressed ship.

Figure 3:
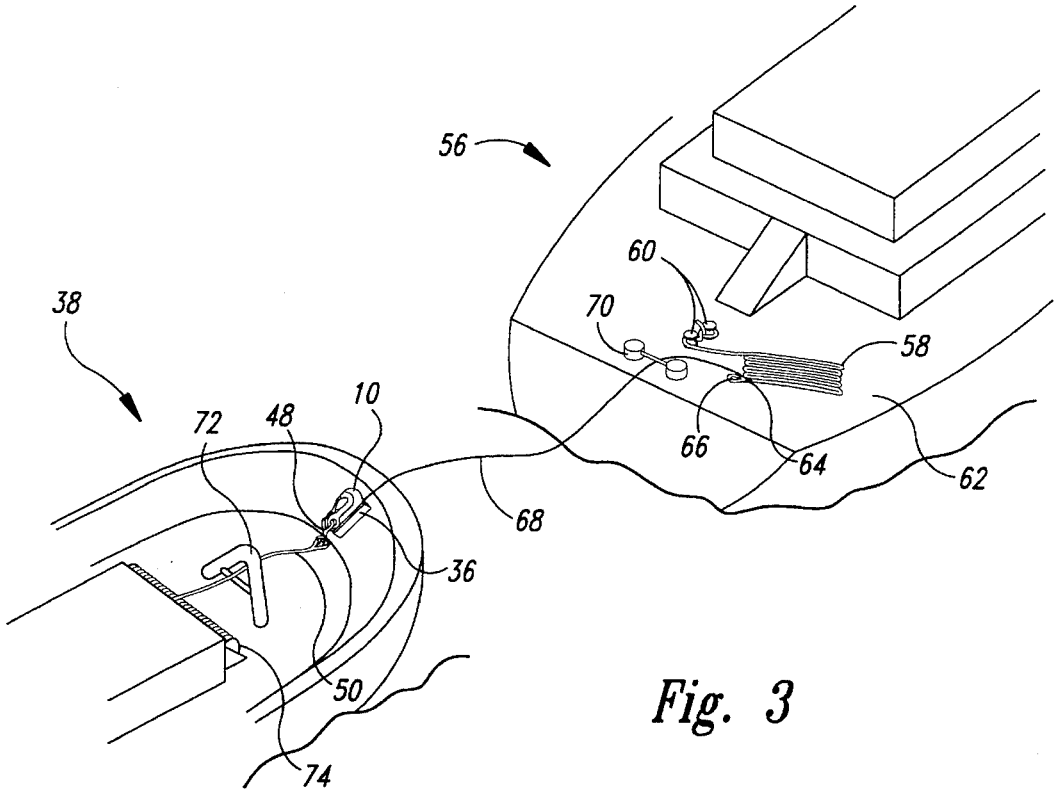
FIG. 3 is a perspective view of the tugboat with a transom link approaching a ship according to the present invention.
Figure 4:
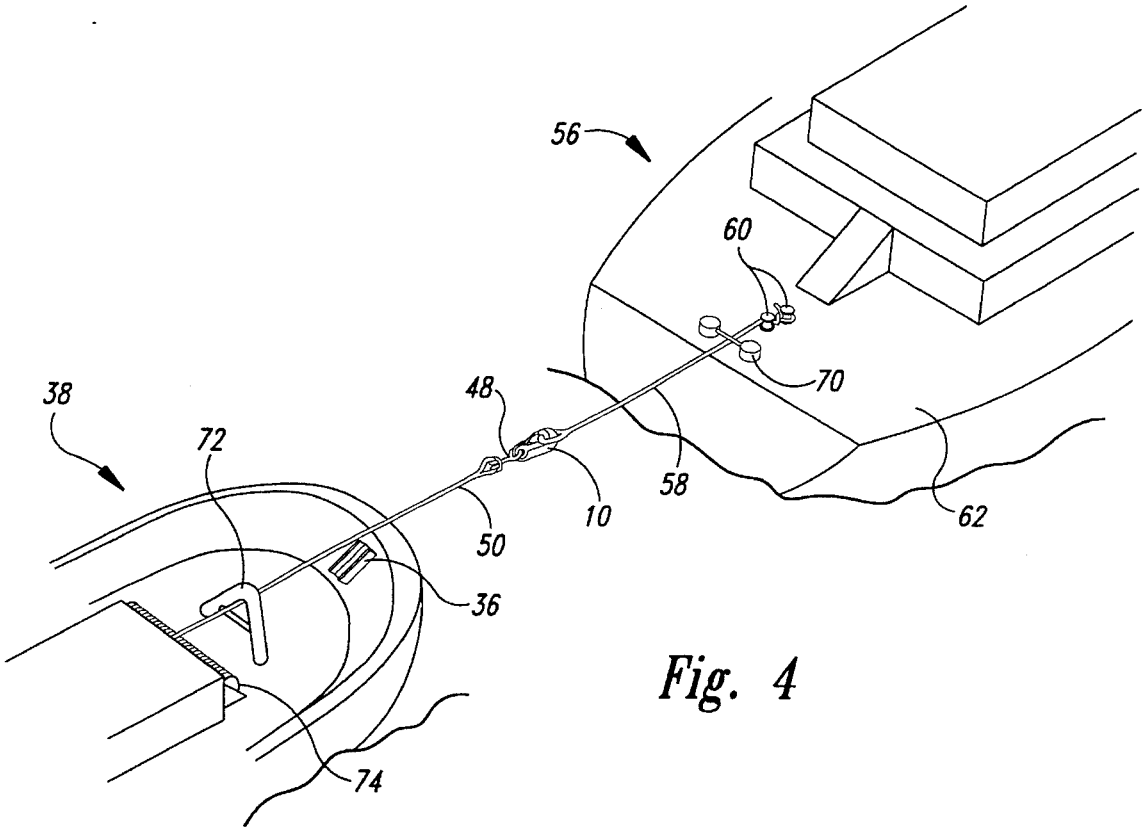
FIG. 4 is a perspective view of the tugboat coupled to the ship via the transom link according to the present invention.
Figure 5:
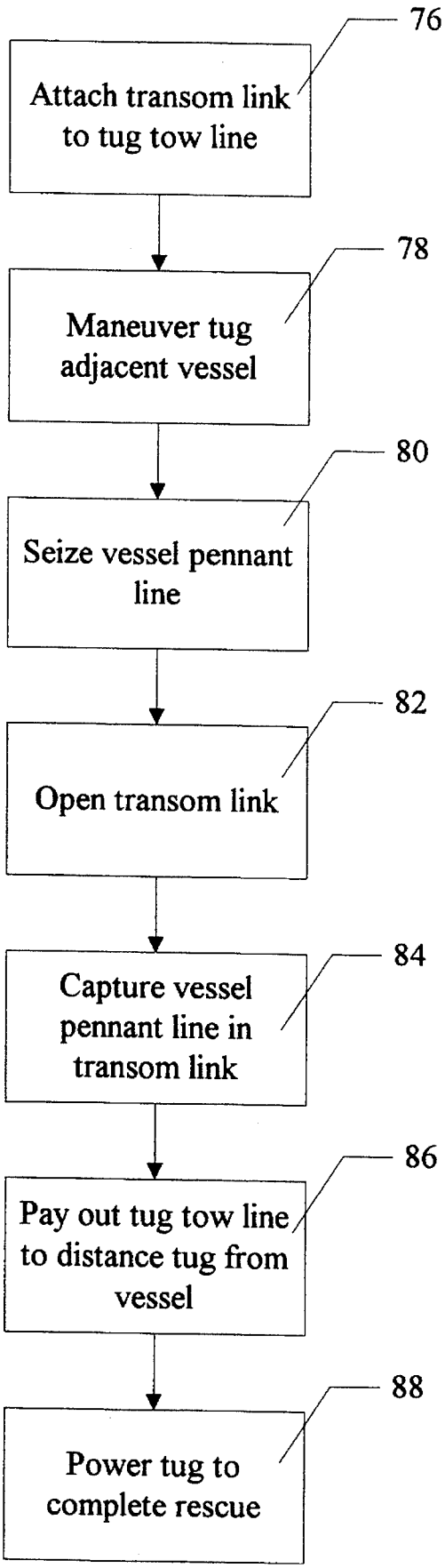
FIG. 5 is a flow diagram of a method of capturing a ship using a transom link according to the present invention.

Shown in FIGS. 3–5 is a method of capturing an escorted ship 56 using the tugboat 38 according to the present invention. In many cases, the method captures the escorted ship 56 in a rescue situation in which the escorted ship and the tugboat 38 remain in motion while capturing the escorted ship 56. As shown in FIG. 3, the escorted ship 56 has a pennant line 58 affixed to appropriate bitts 60 secured to a transom 62 of the escorted ship. The escorted ship's pennant line 58 includes a free end 64 having a closed eye 66 for attaching to the transom link 10 on the tugboat 38. Coupled to the free end 64 of the pennant line 58 is a tag line 68 that is led through a chock 70 affixed to the transom 62 of the escorted ship 56. The tag line 68 is led through the chock 70 so that when the tag line is seized by a crew member of the tugboat 38, the escorted ship's pennant line 58 will follow through the chock. Preferably, the chock 70 is positioned centrally on the transom 62 to ensure that the pennant line 58 is pulled from a central area of the escorted ship to thereby maintain a stable connection with the tugboat 38.

Upon being alerted to the distress of the escorted ship 56, the crew of the tugboat 38 prepares to deploy the transom link 10. As discussed above with respect to FIG. 2, the transom link 10 is connected to the tow line 50 of the tugboat 38 via the link pennant 48. The tow line 50 is led through a towing staple 72 from a tow line winch 74 as is well known in the art.

To rescue the escorted ship 56 using the transom link 10, the tugboat 38 maneuvers its stern to a position adjacent the stern of the escorted ship 56. In order to maneuver the tugboat 38 adjacent the stern of the escorted ship 56 and keep pace with the escorted ship during the rescue, the tugboat preferably can power in any direction, such as is accomplished by the Foss tractor tugs manufactured by the assignee of the present invention. As will be appreciated, the tugboat 38 could also maneuver to the bow of the escorted ship 56 to tether to a pennant line attached to the bow of the escorted ship. In addition, the tugboat 38 could maneuver its bow to either end of the ship and deploy the transom link 10 from the bow of the tugboat.

After the tugboat 38 has maneuvered adjacent the escorted ship 56, the tag line 68 is seized by a crew member on the tugboat. Preferably, the tugboat crew member seizes the tag line using a pike pole which, as well known in the art, is pole with a hook on its end. The tag line 68 preferably hangs down from the transom 62 of the escorted ship 56 at all times so that it can be seized by the crew member of the tugboat 38 without any assistance from a crew member of the escorted ship. Alternatively, a crew member on the escorted ship 56 could pass the tag line through the chock 70 and to the crew member of the tugboat 38 when it is necessary for the tugboat to capture the escorted ship. After seizing the tag line 68, the crew member of the tugboat 38 pulls the tag line to the tugboat and thereby pulls the closed eye 66 of the escorted ship's pennant line 58 to the tugboat. The crew member then forces the pivot arm 26 of the transom link 10 inward, and thus into the open position, and inserts the closed eye 66 so that it encircles the hook member 12. The closed eye 66 receives the hook member tip 16 therethrough so that the closed eye 66 is securely captured by the end saddle 22 of the transom link as the spring 34 closes the pivot arm, thereby connecting the escorted ship's pennant line 58 to the tugboat's tow line 50.

After the ship's pennant line 58 is attached to the transom link 10, the tow line 50 and attached transom link 10 are let out by the tow line winch 74 to release the transom link from the transom link cradle 36 and distance the tugboat 38 from the escorted ship 56. As shown in FIG. 4, the tow line 50 and attached transom link 10 are let out until the transom link 10 is suspended between the tugboat and the escorted ship. The tugboat then maneuvers as needed to complete the rescue and control the escorted ship 56. Typically, the tugboat 38 maneuvers in a direction opposite to the escorted ship's heading to slow down the escorted ship 56 and then changes the heading of the escorted ship as needed to avoid danger. If necessary, the tugboat could tow the escorted ship 56 until the escorted ship can be repaired.

Shown in FIG. 5 is a flow diagram summarizing the method of capturing the escorted ship 56 using the transom link 10 deployed by the tugboat 38. In step 76 of the method, the transom link 10 is attached to the tow line 50 of the tugboat 38 via the link pennant 48 as shown in FIG. 2. In step 78 the tugboat 38 maneuvers adjacent the escorted ship 56 so that the tugboat preferably is in longitudinal alignment with the escorted ship and the tugboat and escorted ship are stern-to-stern. In step 80 a crew member of the tugboat 38 seizes the escorted ship's pennant line 58 preferably by first seizing the tag line 68 attached to the pennant line. In step 82 the crew member of the tugboat opens the transom link 10 by forcing open the pivot arm 26 of the transom link. In step 84 the escorted ship's pennant line 58 is attached to the transom link 10 by capturing the closed eye 66 of the pennant line with the end saddle 22 of the transom link. In step 86, the tow line 50 is paid out by the tugboat's tow line winch 74 to distance the tugboat from the escorted ship a desired distance. In step 88 the tugboat 38 maneuvers as needed to complete the rescue and prevent the escorted ship 56 from being harmed.

As discussed above, the present invention provides a method and apparatus for safely capturing an escorted ship using a tugboat equipped with a transom link. The transom link is a simple apparatus that allows a pennant line of the escorted ship to be quickly and safely attached to a tow line of the tugboat. As a result, the present invention is very effective in preventing environmental and human disasters caused by an escorted ship losing the ability to maneuver away from dangerous obstacles.

It is to be understood that even though various embodiments and advantages of the present invention have been set forth in the foregoing description, the above disclosure is illustrative only, and changes may be made in detail, yet remain within the broad principles of the invention. Therefore, the present invention is to be limited only by the appended claims.

What is claimed is:

1. A transom link for dynamically capturing a pennant line of a ship using a tugboat, comprising:

an oblong hook member having a hook tip coupled to a hook base by an end saddle and a back arm, the hook tip and hook base forming an opening therebetween, the hook member having a transverse bore sized to attach a tow line of the tugboat, the hook base including a bridge member having a pair of spaced-apart side arms;

a pivot arm pivotally attached to the side arms of the bridge member by a pivot pin extending between the side arms of the bridge member, the pivot arm being of sufficient length to span the opening and engage the hook tip and thereby close the opening of the link member and form an enclosed interior area in the transom link; and a spring biasing the pivot arm to close the opening of the link member and capture an eye of the ship's pennant line within the transom link enclosed interior area.

2. The transom link of claim 1 wherein the pivot arm includes a pair of spaced-apart side walls adjacent the side arms of the bridge member and the pivot pin extends through the side walls of the pivot arm and the side arms of the bridge member to pivotally attach the pivot arm to the hook base.

3. The transom link of claim 1 wherein the spring fits at least partially between the side arms.

4. The transom link of claim 1 wherein the transverse bore extends through the hook base opposite to the end saddle and the end saddle is sized to extend through the eye of the ship's pennant line so that the ship's pennant line is coupled to the link member at an opposite end from the tow line of the tugboat.

5. The transom link of claim 1, further comprising a support ridge integrally coupled to, and extending radially outward from, the end saddle and the back arm, thereby providing the transom link with sufficient strength to control the ship with the tugboat.

6. A transom link for dynamically capturing a pennant line of a ship using a tugboat, comprising:

an oblong hook member having a hook tip coupled to a hook base by an end saddle and a back arm, the hook tip and hook base forming an opening therebetween, the hook member having a transverse bore sized to attach a tow line of the tugboat;

a pivot arm pivotally attached to the hook base, the pivot arm being of sufficient length to span the opening and engage the hook tip and thereby close the opening of the link member and form an enclosed interior area in the transom link;

a spring biasing the pivot arm to close the opening of the link member and capture an eye of the ship's pennant line within the transom link enclosed interior area; and a cradle attachable to the tugboat, the cradle including a resilient bed member and the oblong link member being releasably coupled in a fixed position within the resilient bed member.

7. The transom link of claim 6 wherein the resilient bed member includes a slot sized to capture at least a portion of the back arm of the hook member in a manner that displaces the hook member opening from the resilient bed member.

8. The transom link of claim 6 wherein the cradle includes a rigid shell member affixed to the tugboat, the rigid shell member supporting the resilient bed member.

9. A method of dynamically capturing a ship moving in a forward direction using a tugboat equipped with a transom link, the transom link including an oblong link member with a opening formed in one side of the link member and a pivot arm pivotally coupled to the link member, the pivot arm being movable into an open position and biased to close the link member opening, the method comprising:

attaching the transom link to a tow line of the tugboat;

seizing a pennant line of the ship having a first end attached to the ship and a second end with a closed eye while the ship is moving in the forward direction;

opening the transom link by forcing the pivot arm to pivot into the open position while the ship is moving in the forward direction;

inserting the closed eye of the ship's pennant line into the link member opening while the ship is moving in the forward direction;

allowing the pivot arm to close the link member opening while the ship is moving in the forward direction, such that a portion of the link member extends through the closed eye of the ship's pennant line and the closed eye of the pennant line is captured by the link member, thereby coupling the ship to the tugboat; and maneuvering the tugboat in a direction that is different than the forward direction after the ship's pennant line is captured, thereby restraining the motion of the ship.

10. A method of dynamically capturing a ship moving in a forward direction using a tugboat equipped with a transom link, the transom link including an oblong link member with a opening formed in one side of the link member and a pivot arm pivotally coupled to the link member, the pivot arm being movable into an open position and biased to close the link member opening, the method comprising:

attaching the transom link to a tow line of the tugboat;

seizing a pennant line of the ship having a first end attached to the ship and a second end with a closed eye while the ship is moving in the forward direction, the ship's pennant line having a tag line attached thereto, the tag line having a smaller diameter than the pennant line, wherein the step of seizing the ship's pennant line includes first seizing the tag line and pulling the tag line to pull the ship's pennant line to the tugboat;

opening the transom link by forcing the pivot arm to pivot into the open position while the ship is moving in the forward direction;

inserting the closed eye of the ship's pennant line into the link member opening while the ship is moving in the forward direction; and allowing the pivot arm to close the link member opening while the ship is moving in the forward direction, such that a portion of the link member extends through the closed eye of the ship's pennant line and the closed eye of the pennant line is captured by the link member, thereby coupling the ship to the tugboat.

11. A method of dynamically capturing a ship moving in a forward direction using a tugboat equipped with a transom link, the transom link including an oblong link member with a opening formed in one side of the link member and a pivot arm pivotally coupled to the link member, the pivot arm being movable into an open position and biased to close the link member opening, the method comprising:

attaching the transom link to a tow line of the tugboat, wherein the step of attaching the transom link to the tow line of the tugboat includes attaching a transom link pennant line to the tow line and attaching the transom link pennant line to a transverse bore in the transom link;

seizing a pennant line of the ship having a first end attached to the ship and a second end with a closed eye while the ship is moving in the forward direction;

opening the transom link by forcing the pivot arm to pivot into the open position while the ship is moving in the forward direction;

inserting the closed eye of the ship's pennant line into the link member opening while the ship is moving in the forward direction;

allowing the pivot arm to close the link member opening while the ship is moving in the forward direction, such that a portion of the link member extends through the closed eye of the ship's pennant line and the closed eye of the pennant line is captured by the link member, thereby coupling the ship to the tugboat.

12. A method of dynamically capturing a ship moving in a forward direction using a tugboat equipped with a transom link, the transom link including an oblong link member with a opening formed in one side of the link member and a pivot arm pivotally coupled to the link member, the pivot arm being movable into an open position and biased to close the link member opening, the method comprising:

attaching the transom link to a tow line of the tugboat;

seizing a pennant line of the ship having a first end attached to the ship and a second end with a closed eye while the ship is moving in the forward direction;

opening the transom link by forcing the pivot arm to pivot into the open position while the ship is moving in the forward direction:

inserting the closed eye of the ship's pennant line into the link member opening while the ship is moving in the forward direction;

allowing the pivot arm to close the link member opening while the ship is moving in the forward direction, such that a portion of the link member extends through the closed eye of the ship's pennant line and the closed eye of the pennant line is captured by the link member, thereby coupling the ship to the tugboat; and wherein after the ship's pennant line is captured by the link member, letting out the tow line until the transom link is suspended between the ship and the tugboat by the ship's pennant line and the tow line.

13. A method of rescuing a ship while the ship is in motion in a forward direction using a tugboat equipped with a transom link attached to a tow line of the tugboat, the transom link including an oblong link member with an opening formed in one side of the link member and an arm movably coupled to the link member and being of sufficient length to close the opening in the link member, the method comprising:

seizing a pennant line while the ship is in motion in the forward direction, the pennant line having a first end attached to the ship and a second end with a closed eye;

opening the transom link by moving the arm into an open position that exposes the link member opening while the ship is in motion in the forward direction;

inserting the closed eye of the ship's pennant line into the link member opening while the ship is in motion in the forward direction;

closing the link member opening such that a portion of the link member extends through the closed eye of the ship's pennant line, thereby capturing the pennant line and coupling the ship to the tugboat while the ship is in motion in the forward direction; and maneuvering the tugboat in a second direction that is different than the first direction, thereby controlling the motion of the ship.

14. The method of claim 13 usable with the ship's pennant line having a tag line attached thereto, the tag line having a smaller diameter than the pennant line, wherein the step of seizing the ship's pennant line includes seizing the tag line.

15. The method of claim 13, further including maneuvering the tugboat to be adjacent the ship during the recited steps of seizing, opening, inserting and closing.

16. The method of claim 13, wherein after the ship's pennant line is captured by the link member letting out the tow line until the transom link is suspended between the ship and the tugboat by the ship's pennant line and the tow line.

* * * * *